US005165123A

United States Patent [19]

Colpron

[11] Patent Number: 5,165,123

[45] Date of Patent: Nov. 24, 1992

[54] WHEELCHAIR OVERHEAD LIFTING APPARATUS

[76] Inventor: Ishmael C. Colpron, 16504 NE. 88th St., Vancouver, Wash. 98682

[21] Appl. No.: 750,815

[22] Filed: Aug. 27, 1991

[51] Int. Cl.[5] ..... A61G 7/12

[52] U.S. Cl. ..... 5/83.1; 5/86.1; 5/89.1; 254/326; 254/362; 280/304.1; 297/DIG. 4

[58] Field of Search ..... 5/81.1, 83.1, 85.1, 5/86.1, 87.1, 89.1; 297/DIG. 4; 280/304.1; 212/254; 414/921; 254/326, 325, 327, 362

[56] References Cited

U.S. PATENT DOCUMENTS

| | | | |
|---|---|---|---|
| 901,370 | 10/1908 | Poppert | 5/85.1 |
| 2,327,671 | 8/1943 | Rupprecht | 272/7 C |
| 2,339,007 | 1/1944 | Gahm | 5/81.1 |
| 2,587,068 | 2/1952 | Sanders | 5/81.1 |
| 2,666,212 | 1/1954 | Flanders | 5/86.1 |
| 2,792,945 | 5/1957 | Brenny | 212/254 |
| 2,914,110 | 11/1959 | Schulte | 5/81.1 |
| 4,010,499 | 3/1977 | Davis et al. | 5/81.1 |
| 4,141,094 | 2/1979 | Ferguson et al. | 5/81.1 |
| 4,399,572 | 8/1983 | Johansson | 5/81.1 |
| 4,530,122 | 7/1985 | Sanders et al. | 5/83.1 |
| 4,606,082 | 8/1986 | Kuhlman | 5/81.1 |
| 4,941,708 | 7/1990 | Heffner | 297/6 |
| 4,999,862 | 3/1991 | Hefty | 5/81.1 |
| 5,016,300 | 5/1991 | Jandrakovic | 5/85.1 |

*Primary Examiner*—Alexander Grosz
*Attorney, Agent, or Firm*—Marger, Johnson, McCollom & Stolowitz, Inc.

[57] ABSTRACT

An overhead lifting apparatus adapted to a wheelchair lifts a disabled person from the wheelchair to a forward elevated position. The disabled person is rotated and lowered to a second desired location approximate to the front of the wheelchair. The overhead lifting apparatus includes a cable and frame assembly connected to the wheelchair, a harness coupled to the cable and fitted to the disabled person, and a cable driving means such as a winch and battery. The cable driving means is controlled from the wheelchair to lower and raise the disabled person. The winch and battery are located at a rearward portion of the wheelchair behind the hubs of the rear wheels. The location and substantial mass of the winch and battery preventing tipping of the wheelchair.

15 Claims, 3 Drawing Sheets

WHEELCHAIR OVERHEAD LIFTING APPARATUS

BACKGROUND OF THE INVENTION

This invention pertains to an apparatus for moving or transferring a disabled person to or from a wheelchair, and more particularly, to a stand-alone, counterbalanced, overhead lift mechanism adapted to a wheelchair.

Numerous methods and devices exist for transferring disabled persons between a wheelchair and a second location such as a bed, bathtub, or car. One general type of transfer apparatus pushes the disabled person up and out of the wheelchair from below or allows the disabled person to slide from the wheelchair to the second location. Examples of the first method are shown in U.S. Pat. Nos., 2,327,671; 2,339,007; 2,587,068; 2,914,110; 4,010,499; and 4,141,094 (FIG. 1). This method often requires the disabled person to stand up temporarily or otherwise physically assist with the transfer. If the disabled person is unable to assist in the transfer, an assistant having sufficient strength to properly move the disabled person is required. This is extremely undesirable, as the assistant can be an elderly spouse lacking the sufficient physical strength required to assist in the transfer.

A second method lifts the disabled person from above, slides the person to a point above a second location, and lowers the person to the desired second location, eliminating the need of an assistant to physically move the disabled person. Examples of the second method are shown in U.S. Pat. Nos. 4,141,094 (FIGS. 7 and 9) and 4,606,082. This method requires a stationary overhead rail system for receiving and transferring the disabled person while in the raised position. The overhead rail system is typically found in a hospital, convalescent home, or other such handicapped accessible areas. This method can be partially adapted to a wheelchair as shown in FIG. 7 of U.S. Pat. No. 4,141,094. However, specially designed stationary extension rails mounted on the walls throughout the handicapped accessible area are required to prevent the wheelchair from tipping over while the disabled person is in the raised position during the transfer. The process of fitting a normal house with the extension rails is expensive and inconvenient.

Therefore, what is desired is an overhead lifting apparatus adapted for transferring a disabled person to or from a wheelchair that is self-contained and counterbalanced, eliminating additional external steadying mechanisms such as a permanent wall-mounted installation or the need for an assistant to physically steady the wheelchair, and totally supports the weight of the disabled person from above, thus eliminating the need of an assistant to physically aid in the transfer of the disabled person.

SUMMARY OF THE INVENTION

It is therefore an object of the present invention to transfer disabled persons between a wheelchair and a second desired location such as a bed, bathtub, chair, car seat, or the like.

It is another object of the present invention to transfer disabled persons between a wheelchair and a second location without the need of physical strength by an assistant such as an elderly spouse.

It is another object of the present invention to increase the mobility of elderly persons and thus extend the time that they can remain in their own home.

It is an advantage of the present invention that the lifting and transfer apparatus is adapted to a wheelchair and can be removed when not required.

It is a further advantage of the present invention that the adapted wheelchair can fit through doors of standard dimensions.

It is still a further advantage of the present invention that no special equipment or installations throughout the disabled person's home are required.

According to the present invention, the overhead lifting apparatus includes a cable and frame assembly connected to the wheelchair, a padded harness coupled to the cable and fitted to the disabled person, and a cable driving means such as a winch and battery. The cable driving means is controlled from the wheelchair to lower and raise the disabled person. The winch and battery are located at a rearward portion of the wheelchair behind the hubs of the rear wheels. The location and substantial mass of the winch and battery form an effective counterbalance to the weight of the disabled person in the forward elevated position, thus preventing tipping of the wheelchair.

In operation, a disabled person is transferred between the wheelchair and another, proximate location such as a bed, bathtub, or car seat. After the wheelchair is moved as close as possible to the desired second location, the disabled person is fitted with the padded harness. The control panel is then accessed by the disabled person or by an assistant to energize the cable driver and raise the harness and disabled person to an elevated forward position, thus completely supporting the weight of the disabled person from above. When the harnessed disabled person is completely suspended in the elevated forward position, he may be easily rotated without the use of physical exertion by the assistant, such as an elderly spouse. Once the disabled person is in the proper position, the harness is lowered to the desired second location. As the harness is being lowered, the disabled person is guided by an assistant, but this also does not require physical exertion on the part of the assistant since the disabled person is completely suspended from above by the action of the overhead lifting apparatus. Throughout the transfer process, the wheelchair is at all times properly balanced and tipping of the wheelchair is prevented by the correct positioning of the cable driver at the rearward portion of the wheelchair.

The foregoing and other objects, features and advantages of the present invention are more readily apparent from the following detailed description of a preferred embodiment that proceeds with reference to the drawings.

DETAILED DESCRIPTION

Figure 1:
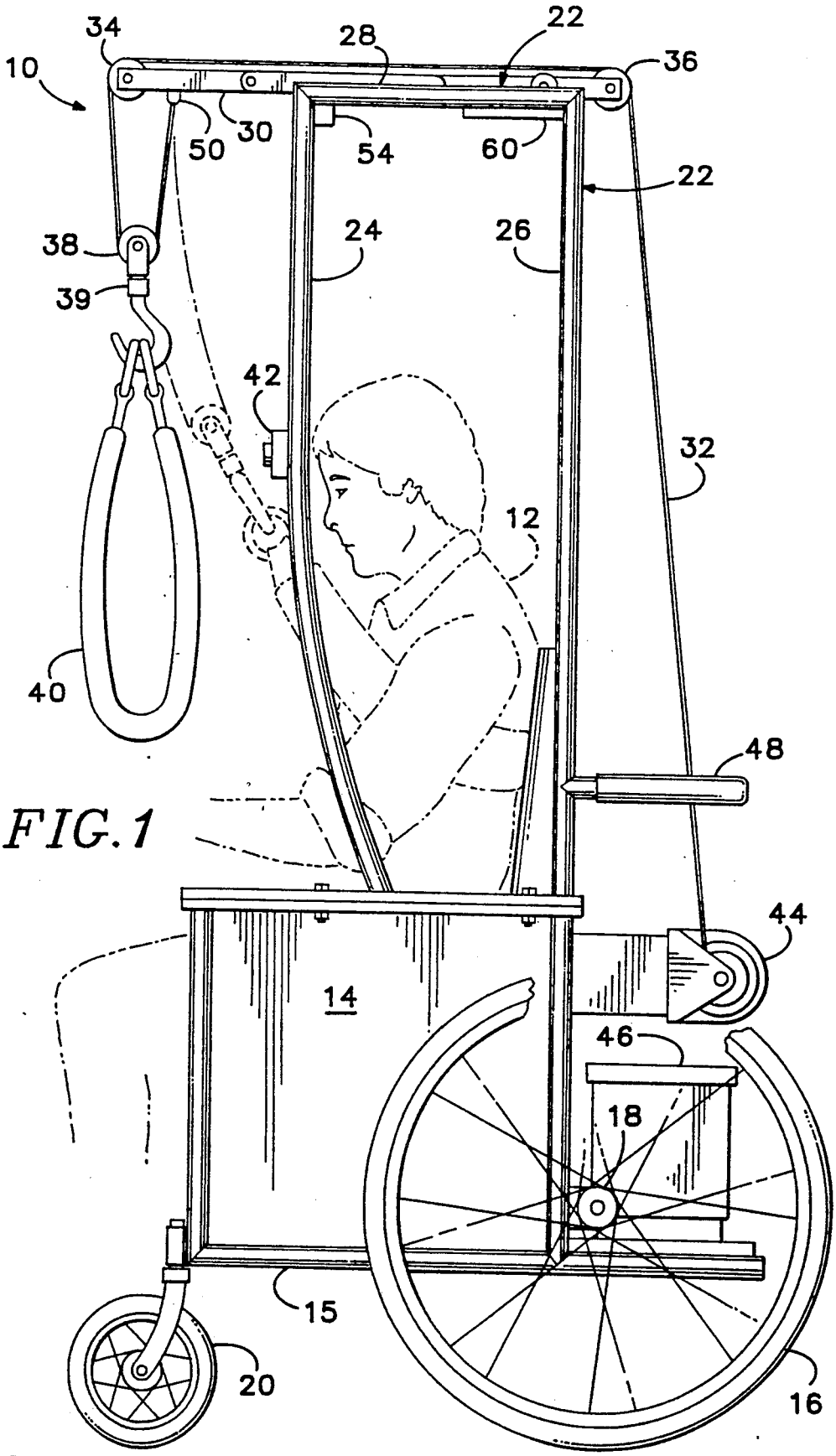
FIG. 1 is a side view of the overhead lifting apparatus and wheelchair according to the present invention.

Referring now to FIG. 1, the overhead lifting apparatus 10 of the present invention is adapted to a wheelchair 14 having a pair of small forward wheels 20 and a pair of larger rear wheels 16, as well as an extended bottom platform 15 to receive certain components of the overhead lifting apparatus. The configuration and function of the extended bottom platform 15 is explained in further detail below. The overhead lifting apparatus includes a cable and frame assembly 22, 32 connected to the wheelchair by first and second vertical members 24 and 26.

Vertical members connecting the frame 22 on the right-hand side of wheelchair 14 are not shown in FIG. 1. A first horizontal member 28 connects the first and second vertical members 24 and 26. A second horizontal member is not shown in FIG. 1. The frame 22 includes a central overhead member 30 that extends forward from a rearward portion of the frame 22. The central overhead member 30 is supported by a forward crossbar 54 and by a platform 60. The forward crossbar 54 and the platform 60 brace and connect the left and right portions of the frame 22 to form a rigid, rectangular box-like structure.

The central overhead member 30 further includes forward and rear rollers 34 and 36 that are grooved for receiving and guiding the cable 32. A padded harness 40 is coupled to a first end of the cable 32 through pulley 38 and swivel-mounted hook 39. The first end of the cable 32 is terminated on the central overhead member at termination point 50. The configuration of pulley 38 and the cable 32 provides a mechanical advantage. If desired, the cable 32 can terminate directly to the swivel-mounted hook 39, however no mechanical advantage is realized. The harness 40 is adapted to support the entire weight of a disabled occupant 12 of the wheelchair 14 by comfortably fitting around the back and underneath the armpits as shown in FIG. 1.

The cable 32 is raised and lowered by a cable driver including a winch 44 and a battery 46. The winch 44 is coupled to a second end of the cable 32 to raise and lower a harnessed occupant 12 between a first, lower seated position and a second, upper and slightly forward position. The cable driver is located at a rearward portion of the wheelchair 14. The winch 44 is coupled to the rearward portion of the frame of the wheelchair 14 and the battery 46 rests on the extended bottom platform 15 of the wheelchair 14. The cable drive 44, 46 has substantial mass sufficient to counterbalance the wheelchair 14 when the harnessed occupant 12 is in the second, upper and forward position. To achieve the counterbalance, the cable driver is located substantially behind a vertical plane defined by the hubs 18 of the rear wheels 16 of the wheelchair 14.

The overhead lifting apparatus 10 further includes a user-accessible control panel 42 located on the first vertical member 24 for controlling the movement of the cable 32. A pair of handles 48 coupled to the rearward vertical members 26 of the frame 22 are included for pushing the wheelchair 14 to a desired location in the normal manner. The entire lifting apparatus 10 is detachable from the wheelchair 14 by four bolts or other connecting means located at the base of vertical members 24 and 26 for ease of transportation.

Figure 2:
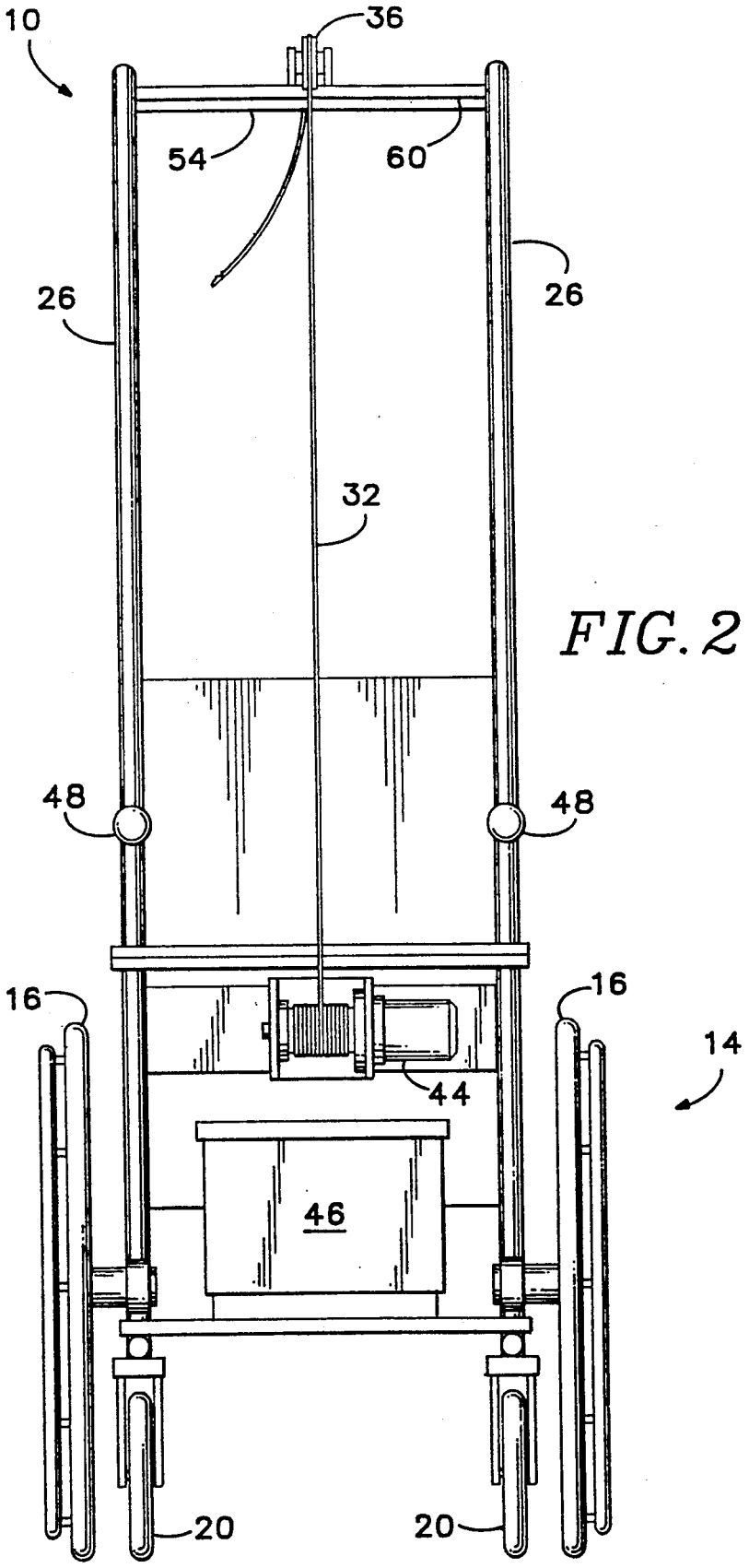
FIG. 2 is a rear view of the overhead lifting apparatus and wheelchair shown in FIG. 1.

Referring now to FIG. 2, further details of the configuration of the overhead lifting apparatus 10 are revealed including the two rear vertical members 26 and the platform 60 that supports the horizontal central overhead member 30.

Figure 3:
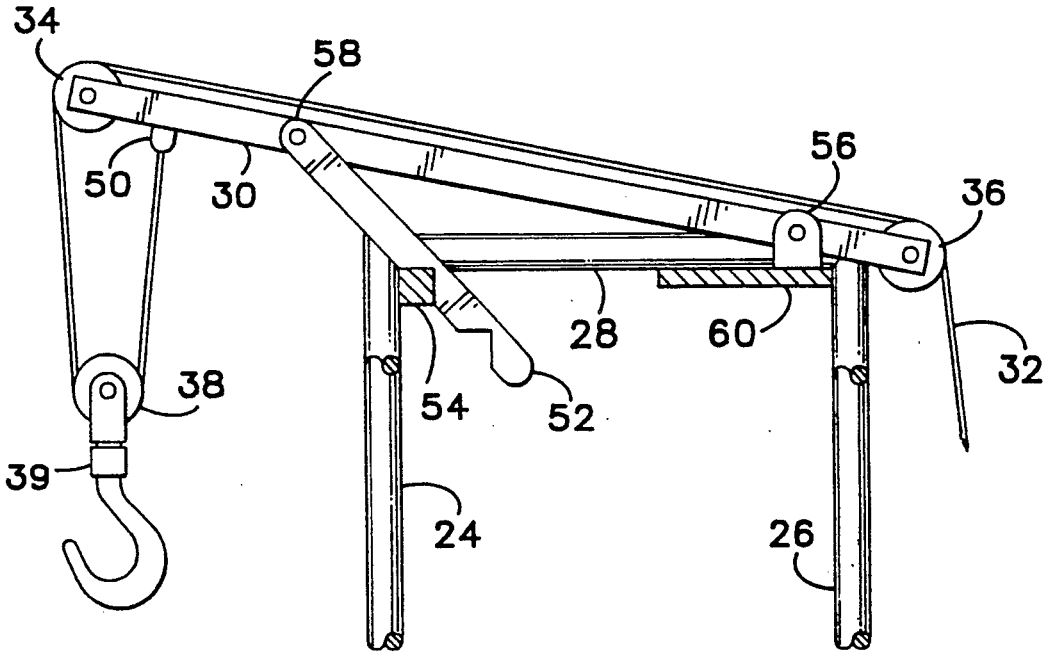
FIG. 3 is a detailed cutaway side view of a locking adjustment member for adjusting the horizontal central overhead member shown in FIG. 1.

Referring now to FIG. 3, overhead lifting apparatus 10 further includes a locking adjustment feature for varying the height of the forward end of the central overhead member 30 in order that disabled persons of different heights may be accommodated. The locking adjustment feature includes a hinge 56 for rotably attaching the central overhead member 30 to the frame 22. A notched locking member 52 is rotatably attached to the central overhead member 30 by hinge 58. The notches in the locking member 52 are sized to mate with the forward crossbar 54. Thus, the locking adjustment feature provides three or more locked height adjustment positions.

In operation, a disabled person 12 is transferred between the wheelchair 14 and another, proximate location such as a bed, bathtub, or car seat. After the wheelchair 14 is moved as close as possible to the desired second location, the disabled person 12 is fitted with the padded harness 40. The control panel 42 is accessed by the disabled person 12 or by an assistant to energize the cable driver and raise the harness 40 and disabled person 12 to an elevated forward position.

When the harnessed disabled person 12 is in the elevated forward position, he may be easily rotated without the use of physical exertion by the assistant, such as a spouse, to a rearward facing direction, if this is required. For example, the rotation may be desirable if the disabled person is to be placed on a proximately located couch or chair. Once the disabled person 12 is in the proper position over the second location, the harness 40 is lowered to the desired second location. Throughout the transfer process, the wheelchair 14 is at all times properly balanced and tipping of the wheelchair 14 is prevented by the correction positioning of the cable driver at the rearward portion of the wheelchair 14 as described above. During the transfer process it may be desirable to guide the harnessed disabled person 12 between the first, seated location and the second location. Guiding the disabled person 12 does not require physical exertion on the part of the assistant since the weight of the disabled person 12 is completely suspended from above by the action of the overhead lifting apparatus 10.

The overhead lifting apparatus 10 is also well suited to transfer a disabled person 12 from a prone position on the floor or another location to the wheelchair. The wheelchair is located as closely as possible to the disabled person 12. Subsequently, the disabled person is fitted with the padded harness 40, raised, rotated if necessary, and lowered into the wheelchair 14. The transfer of a disabled person 12 from a prone position also does not require physical strength on the part of the assistant to either steady the wheelchair 14 or to otherwise assist in the transfer.

In the preferred embodiment, it is contemplated that all vertical and horizontal members, including the central overhead member 30 are fabricated of a tubular material such as a pipe to reduce the overall weight of the lifting apparatus 10 while maintaining strength and rigidity. The exact shape and configuration of the frame 22 can be changed in many ways while providing adequate support for the loaded cable 32 and harness 40. The exact configuration of the connection between the cable 32 and the harness 40 can also be changed. For example multiple pulleys 38 can be used to achieve a greater mechanical advantage. Other types of harnesses 40 can be used to provide greater support around the torso and legs of the disabled person 12.

Having illustrated and described the principles of my invention in a preferred embodiment thereof, it is apparent to those skilled in the art that the invention can be modified in arrangement and detail without departing from such principles. I claim all modifications coming within the spirit and scope of the accompanying claims.

I claim:

1. An overhead lifting apparatus for attachment to a wheelchair having a pair of forward wheels and a pair of rear wheels, the overhead lifting apparatus comprising:

a cable and frame assembly for being mounted on a wheelchair, the frame assembly including a central overhead member extending forward from a rearward portion of the frame, the central overhead member including means for guiding the cable;

a harness coupled to a first end of the cable, the harness being adapted to support an occupant of the wheelchair; and cable driving means coupled to a second end of the cable for raising and lowering a harnessed occupant between a first, lower position and a second, upper position, means for mounting the cable driving means in a fixed position on a rearward portion of the wheelchair;

the cable driving means having a substantial mass sufficient to counterbalance the wheelchair when the harnessed occupant is transferred between the first position and the second position.

2. An overhead lifting apparatus as in claim 1 further comprising a locking adjustment means for varying the height of the forward end of the central overhead member.

3. A method of transferring a disable person between a wheelchair and another, proximate location, the method comprising:

providing a harness for supporting the entire weight of a disabled person;

engaging the disabled person with the harness;

raising the harness and the disabled person from a first location in the wheelchair to an elevated forward position relative to the wheelchair;

locating the wheelchair such that the disabled person is completely suspended above a second location proximate to the wheelchair;

lowering the harness to place the harnessed disabled person in the second locaton;

providing a counterbalance means located entirely on the wheelchair; and positioning the counterbalance means at a rearward portion of the wheelchair as a sole stabilizing means to prevent the wheelchair from tipping when the harnessed disabled person is transferred between the first location and the second location.

4. A method of transferring a disabled person as in claim 3 further comprising the step of guiding the harnessed disabled person between the first and second locations.

5. A method of transferring a disabled person as in claim 4 further comprising the step of rotating the harness in the elevated forward position.

6. A method of transferring a disabled person as in claim 3 in which the step of engaging the disabled person comprises placing the harness around the back and underneath the armpits of the disabled person.

7. A method of transferring a disabled person as in claim 3 in which the step of raising the harness comprises:

providing a cable coupled to the harness;

providing a cable driver located on the wheelchair; and activating the cable driver to retract the cable and raise the harness.

8. A method of transferring a disabled person as in claim 3 in which the step of lowering the harness comprises:

providing a cable coupled to the harness;

providing a cable driver located on the wheelchair; and activating the cable driver to extend the cable and lower the harness.

9. A method of transferring a disabled person as in claim 3 in which the step of providing a counterbalance means comprises:

providing a cable;

coupling a first end of the cable to the harness;

providing a winch located entirely on the wheelchair;

coupling a second end of the cable to the winch to raise and lower the harness.

10. A method of transferring a disabled person as in claim 3 in which the step of positioning the counterbalance means comprises locating the counterbalance on a portion of an extended bottom platform of the wheelchair behind a vertical plane defined by the hubs of a pair of rear wheels of the wheelchair.

11. An overhead lifting apparatus and wheelchair assembly comprising:

a wheelchair;

a cable having first and second ends;

a frame including a vertical member connected to a rearward portion of the wheelchair and a horizontal central overhead member coupled to an upper portion of the vertical member, the overhead member extending forward to at least the front of the wheelchair and including means for guiding the cable;

a locking adjustment means for varying the height of the forward end of the central overhead member;

a harness coupled to the first end of the cable, the harness being adapted to support an occupant of the wheelchair;

a pulley system located at the forward end of the central overhead member operatively connected to the cable and including means for receiving the harness;

a winch coupled to the second end of the cable for raising and lowering a harnessed occupant between a first, lower position and a second, upper position; and a battery for providing electrical power to the winch.

the winch and battery being located behind a vertical plane defined by the hubs of the larger rear wheels of the wheelchair and having substantial mass sufficient to counterbalance the wheelchair and lifting apparatus when the harnessed occupants is in the second, upper position.

12. An overhead lifting apparatus for attachment to a wheelchair having a pair of forward wheels and a pair of rear wheels, the overhead lifting apparatus comprising:

a cable having first and second ends;

a frame including a vertical member connected to a rearward portion of a wheelchair and a horizontal central overhead member coupled to an upper portion of the vertical member, the overhead member extending forward to at least the front of the wheelchair and including means for guiding the cable;

a locking adjustment means for varying the height of the forward end of the central overhead member;

a harness coupled to the first end of the cable, the harness being adapted to support an occupant of the wheelchair;

a pulley system located at the forward end of the central overhead member operatively connected to the cable and including means for receiving the harness;

a winch coupled to the second end of the cable for raising and lowering a harnessed occupant between a first, lower position and a second, upper position; and a battery for providing electrical power to the winch.

means connected to the frame for mounting the winch and battery behind a vertical plane defined by the hubs of the larger rear wheels of the wheelchair and having substantial mass sufficient to counterbalance the wheelchair and lifting apparatus when the harnessed occupant is in the second, upper position.

13. An overhead lifting apparatus as in claim 12 in which the first end of the cable is terminated in the central overhead member.

14. An overhead lifting apparatus as in claim 12 further comprising user-accessible control means located on the frame for controlling the cable driving means.

15. An overhead lifting apparatus as in claim 12 in which the harness is swivel-mounted to the first end of the cable.

* * * * *